US005314102A

United States Patent [19]

Roy

[11] Patent Number: 5,314,102

[45] Date of Patent: May 24, 1994

[54] HANDBAG ASSEMBLY

[76] Inventor: Melinda S. Roy, Apt. 9Q, 529 W. 42nd St., New York, N.Y. 10036

[21] Appl. No.: 762,873

[22] Filed: Sep. 19, 1991

[51] Int. Cl.[5] ..... A45F 4/00

[52] U.S. Cl. ..... 224/151; 224/222; 224/901; 150/101; 150/102; 150/133; 150/134

[58] Field of Search ..... 224/151, 222, 219, 221, 224/224, 901; 150/101, 102, 103, 107, 117, 133, 134; 383/4

[56] References Cited

U.S. PATENT DOCUMENTS

| | | | |
|---|---|---|---|
| 710,732 | 10/1902 | Anderson | 224/222 |
| 2,063,850 | 12/1936 | Nemeth et al. | 150/103 |
| 2,711,202 | 6/1955 | Freedman | 224/219 |
| 3,797,043 | 3/1974 | Brument | 383/4 |
| 4,905,881 | 3/1990 | Graber | 224/901 |
| 4,917,505 | 4/1990 | Bullard et al. | 383/4 |
| 5,002,401 | 3/1991 | Blackman | 383/4 |

*Primary Examiner*—Linda J. Sholl

*Attorney, Agent, or Firm*—Darby & Darby

[57] ABSTRACT

A handbag including various fasteners which enable the handbag to be unfastened and reassembled so that it can be worn by the user, for example around the ankle.

7 Claims, 2 Drawing Sheets

HANDBAG ASSEMBLY

The present invention relates to a handbag and, in particular, to a handbag having a construction such that it can be worn by the user when it is undesirable or inconvenient to carry the handbag in the usual fashion.

The use of handbags is, of course, widespread throughout the world. A common problem in public places such as restaurants and theaters is pilferage either of the entire pocketbook or of its contents. On occasion, it may be inconvenient or undesirable to carry the handbag by means of its shoulder strap or other carrying strap. For example, such occasions may arise if the owner wishes to engage in a sport or other recreational activity such as dancing and there is no convenient place to leave the bag.

The object of the present invention is to provide a handbag construction including various fastener means which enable the handbag to be unfastened and subsequently reassembled by means of these fastening means so that it can be worn by the owner, for example around her ankle or any other portion of her body.

In accordance with the preferred embodiment of the invention, the pocketbook is formed and shaped so that when worn around the wearer's ankle as, for example, a boot cover or the like, it appears to be an article of clothing rather than a handbag.

SUMMARY OF THE INVENTION

In accordance with the invention, a handbag comprises an inner pocket and an outer pocket joined together along a common fold line. Detachable fastener strips (for example, Velcro strips) are attached to the free edges of the two pockets and the bottom edges of the pockets so that the pockets can be joined to form a space between them in which the wearer's valuables and other personal property can be stored. If the owner of the handbag does not wish to carry the bag, the fastener means can be unfastened and the pockets wrapped around the wearer's ankle (for example) and secured in place by the same edge fastening means.

DETAILED DESCRIPTION OF THE INVENTION

Figure 1:
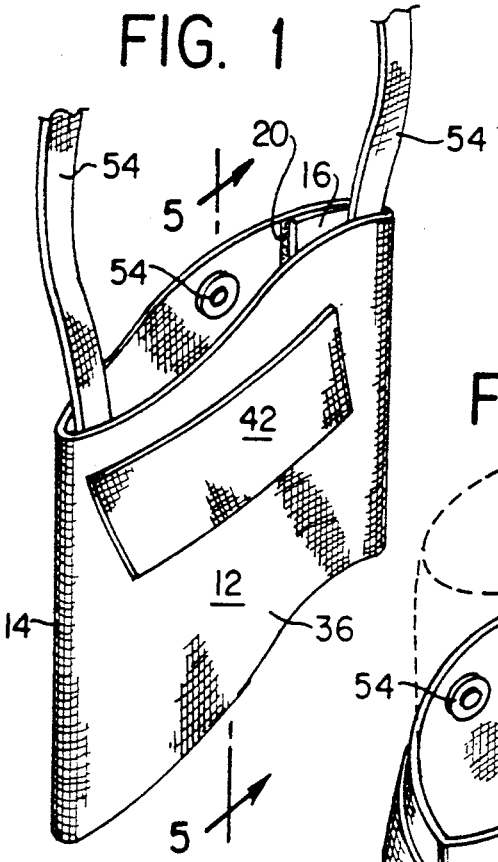
FIG. 1 is a perspective view of an unassembled handbag in accordance with the invention.

The invention includes an inner pocket 10 and an outer pocket 12 joined together by a common edge or fold line 14. As used herein, the terms "inner" and "outer" are used solely for purposes of explanation and are intended to refer to the relationship of the pockets to the wearer when the handbag is being carried as shown in FIG. 1, the inner pocket 10 being the pocket closer to the wearer's body.

The outer pocket 12 includes a closure panel 16 to which a side edge fastener strip 18 is attached. In accordance with the preferred embodiment of the invention, the fastener strips used comprise conventional hook and loop (pile) fasteners of the type sold under the trademark VELCRO although the invention does not depend on the nature of the fastener means. The fastener means such as the side edge fastener strip 18 may be connected to the fabric forming the pockets 10 and 12 in any conventional manner, typically by sewing.

A complementary side edge fastener strip 20 is attached to the interior surface of the pocket 10 at its free edge, i.e., the edge remote from the common fold line 14. In illustrating the complementary fastener strips, the pattern shown on fastener strip 20 represents the hooks and the pattern shown on the fastener strip 18 the loops or pile of a Velcro fastener system.

The pockets 10 and 12 further include complementary bottom edge fastener strips 24 and 26 attached to the interior surfaces of the pockets at their bottom edges. The closure panel 16 likewise includes a bottom edge fastener strip 28 for securing the closure panel 16 to the adjacent or contiguous portion of the pocket 12 when the closure panel is folded along line 30.

The pockets 10 and 12 may be identical in construction and include an inner fabric panel 32 and an outer panel comprising a laminate of a fabric 34 and a decorative fabric such as leather 36. The bottom and side edges of the fabric panels 32 and 34, 36 may be sewn together by stitching (not numbered).

Access to the pockets 10 and 12 is provided by means of respective pocket openings 40 cut into the laminate 34, 36 which is covered by pocket flaps 42 sewn along its top edge to the laminate 34, 36. Alternatively, flaps 42 may be removable by using only suitable complementary fastener strips. Fastener strips 46 (only one shown) may be sewn to the interior surface of the pocket flaps 42. The fasteners 46 engage complementary fastener strips 48 sewn to the outer surface of the fabric laminate 34, 36 immediately below the pocket opening 40.

Vertical strap fastener strips 50 and 52 are sewn to the pockets 10 and 12, respectively, and engage complementary fastener strips (not shown) on the extremities of a shoulder strap 54.

A feature of the preferred embodiment of the invention is the shape of the pockets relative to each other. In this respect, as shown most clearly in FIGS. 3 and 4, the bottom edges of the pockets 10 and 12 form an oblique angle, i.e., an angle greater than 90 degrees but less than 180 degrees and, preferably, an angle of about 150 degrees as illustrated. The upper edges of the pockets 10 and 12 form a similar oblique angle and, while both the upper and lower edges are curved, the curve of the upper edges is more pronounced. Also, in accordance with the preferred embodiment of the invention, the shape of the closure panel 16 is such that when it is folded along line 30 to abut the interior surface of pocket 12, its shape is identical to the shape of the contiguous portion of the pocket 12.

Figure 3:
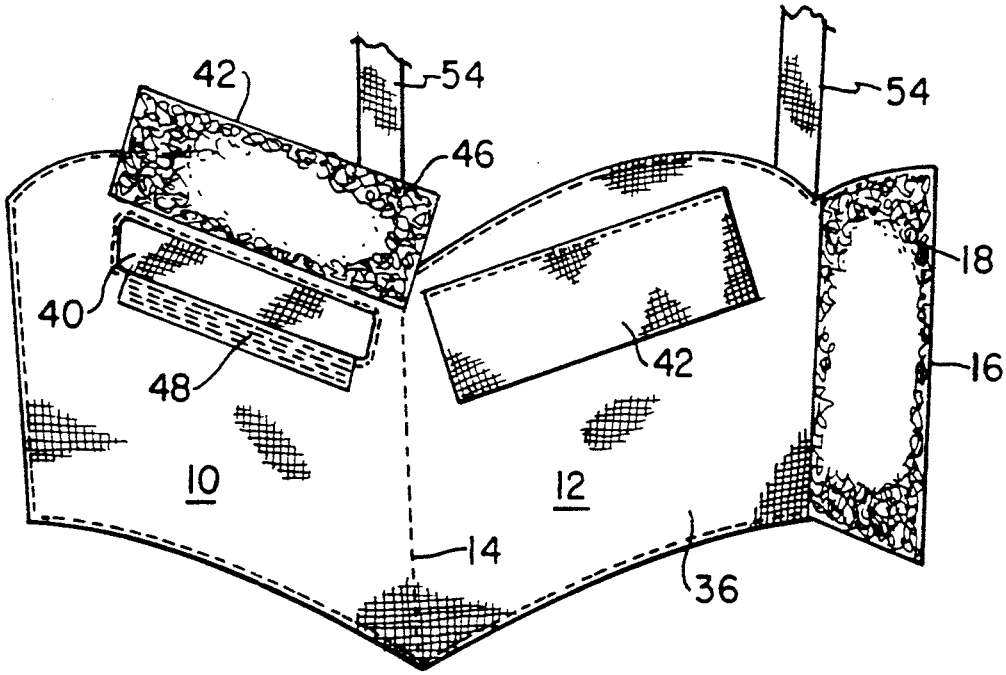
FIG. 3 is a plan view of the exterior surface of a handbag in accordance with the invention with all of the fastening means unfastened.
Figure 4:
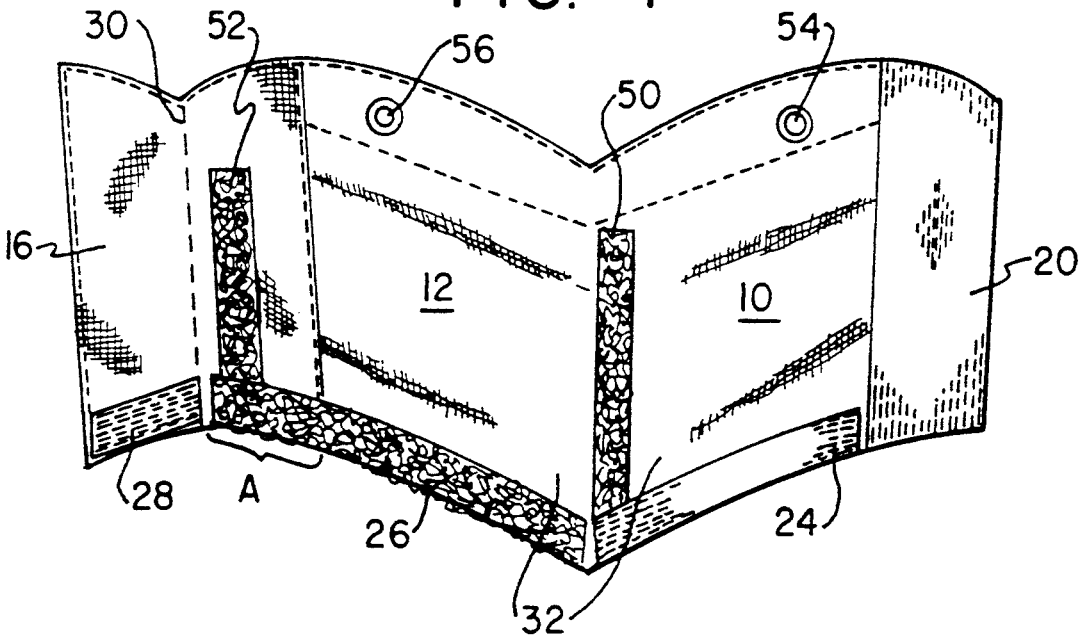
FIG. 4 is a plan view of the interior surface of the unfastened handbag.

To use the handbag, the pocket assembly may be opened as shown in FIGS. 3 and 4. Strap 54 is attached to the fastener strips 50 and 52. Next, the closure panel 16 is folded along line 30 so that fastener strips 28 and portion A of the fastener strip 26 engage each other, thereby exposing the side edge fastener 18. The pocket 10 is then folded about the fold line 14 so that the side edge fastener strip 20 engages the side edge fastener 18 and, simultaneously, the bottom edge fastener strips 24 and 26 are brought together into fastening engagement. In this way, the handbag assembly shown in FIG. 1 is formed with the space 60 between the pockets 10 and 12 available also for the purpose of storing the owner's personal property. If desired, complementary snap fasteners 54 and 56 may be provided to close the top of the handbag. The user may thus use the handbag construction in conventional fashion.

Figure 2:
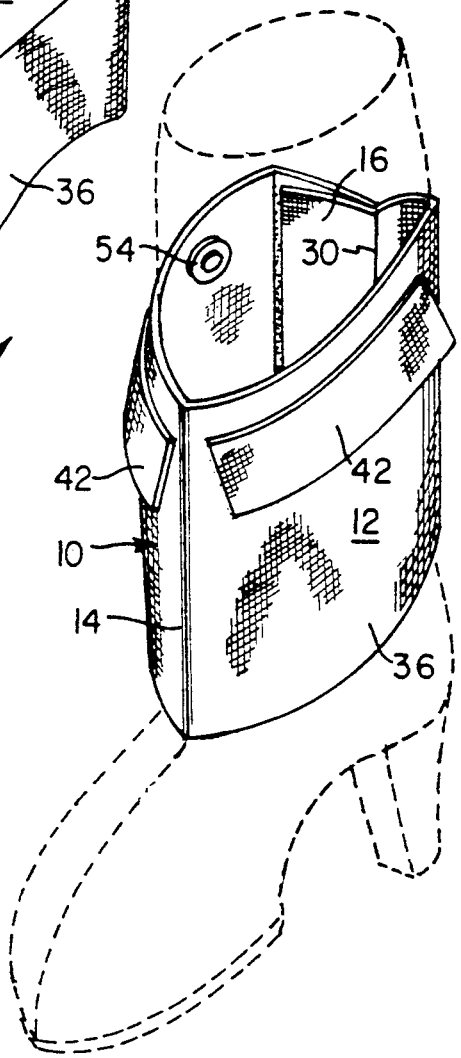
FIG. 2 is a perspective view of the handbag in accordance with the invention wrapped around the upper portion of a boot.
Figure 5:
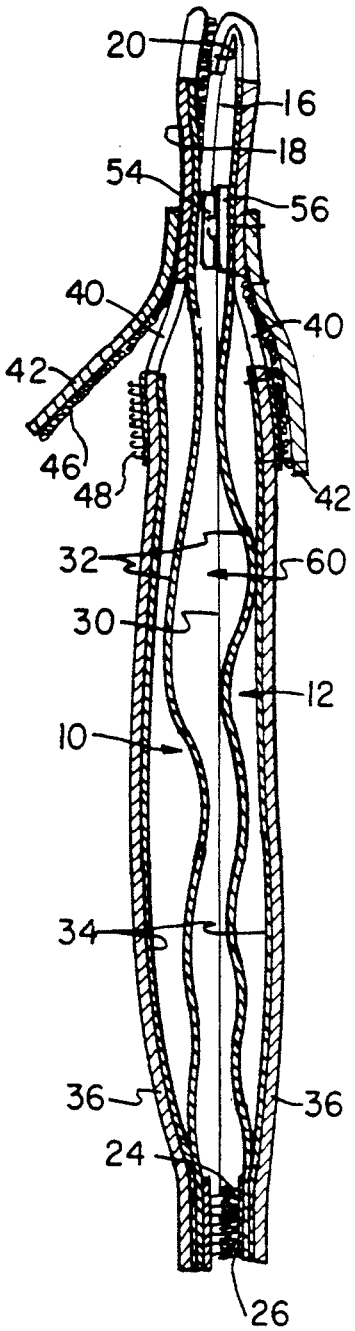
FIG. 5 is a side sectional view along the line 5—5 of FIG. 1.

If for any reason the owner no longer wishes to carry the handbag, she may unfasten and open the handbag into the condition shown in FIGS. 3 and 4. She may then remove the strap 54 and wrap the opened pocket assembly around her ankle, bringing the side edge fastener strips 18 and 20 into engagement with each other to secure the assembly securely around her ankle, as shown in FIG. 2. In this condition, of course, the space 60 is no longer available for storage but the pockets 10 and 12 are. Because of the shape of the pocket assembly as shown in FIGS. 3 and 4, when the assembly is wrapped around the wearer's ankle either at the top of a shoe or perhaps near the bottom of a boot, the beveled edges create a fashionable appearance which makes the device appear more as an article of clothing than a handbag. With the bag wrapped around the wearer's ankle, she can easily engage in many sporting and recreational activities without the inconvenience of having to carry the handbag.

As indicated above, other types of fastener means besides Velcro fasteners can be used and obviously different shapes and configurations are contemplated by the invention. For example, the pocket assembly may be sized and shaped so as to be worn conveniently around the wearer's arm or wrist or even around her waist.

What is claimed is:

1. A handbag, comprising:

an inner pocket, an outer pocket, said inner and outer pockets each having a free side edge and a common side edge, each said pocket having an opening providing access to the interior of said pocket, the lower edges of said inner and outer pockets forming an oblique angle with the apex of said oblique angle at said common edge, the upper edges of said inner and outer pockets forming an oblique angle with the apex of said oblique angle at said common edge, one of said pockets including first free side edge fastener means, the other of said pockets including second free side edge fastener means engageable with said first free side edge fastener means for fastening together the free edges of said inner and outer pockets to form a space between said pockets which comprises the interior compartment of said handbag with both pocket openings being accessible from the exterior of the handbag, and complementary bottom edge fastener means attached to the lower portions of said inner and outer pockets for fastening the interior lower portions of said inner and outer pockets together to close the bottom of said interior compartment so that articles can be stored in said interior compartment, but whereby said first and second free side edge fastener means and said complementary bottom edge fastener means can be unfastened and said inner and outer pockets wrapped around a part of a wearer's body and secured in place on the wearer's body by said first and second side edge fastener means.

2. A handbag according to claim 1, wherein said first side edge fastener means is attached to the exterior surface of said one pocket and said second side edge fastener means is attached to the interior surface of said other pocket.

3. A handbag according to claim 2, wherein said one pocket includes a closure panel and said first side edge fastener is attached to said closure panel.

4. A handbag according to claim 3, further including bottom edge fastener means on a surface of said closure panel for engaging a portion of the bottom edge fastener means on said one panel.

5. A handbag according to claim 1, including a strap, and complementary fastener means on said strap and said pockets for detachably retaining said strap.

6. A handbag according to claim 1, including exterior openings for providing access to said pockets, pocket flaps on the exterior surfaces of said pockets for closing said openings and fastening means for detachably fastening said flaps to said pockets.

7. A handbag according to claim 1, wherein the upper surfaces of said handbag are curved.

* * * * *